US011230803B2

(12) United States Patent
Hombroek et al.

(10) Patent No.: US 11,230,803 B2
(45) Date of Patent: *Jan. 25, 2022

(54) LAUNDRY WASHING MACHINE WITH AUTOMATIC SELECTION OF LOAD TYPE

(71) Applicant: Midea Group Co., Ltd., Foshan (CN)

(72) Inventors: Phillip C. Hombroek, Louisville, KY (US); Christopher G. Hoppe, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 244 days.

This patent is subject to a terminal disclaimer.

(21) Appl. No.: 16/355,690

(22) Filed: Mar. 15, 2019

(65) Prior Publication Data

US 2019/0211492 A1 Jul. 11, 2019

Related U.S. Application Data

(62) Division of application No. 15/198,865, filed on Jun. 30, 2016, now Pat. No. 10,273,622.

(51) Int. Cl.
*D06F 34/18* (2020.01)
*D06F 35/00* (2006.01)
(Continued)

(52) U.S. Cl.
CPC ..... *D06F 34/18* (2020.02); *D06F 35/006* (2013.01); *D06F 39/087* (2013.01); *D06F 33/00* (2013.01);
(Continued)

(58) Field of Classification Search
CPC .... D06F 35/005; D06F 35/006; D06F 39/087; D06F 39/088; D06F 33/00; D06F 33/36; D06F 33/38; D06F 33/40; D06F 34/18; D06F 2101/00; D06F 2103/02; D06F 2103/04; D06F 2103/06; D06F 2103/18; D06F 2105/02; D06F 2105/10; D06F 2105/48; D06F 2105/58
See application file for complete search history.

(56) References Cited

U.S. PATENT DOCUMENTS 4,257,708 A 3/1981 Fukuda
4,889,644 A 12/1989 Amberg et al.
(Continued)

FOREIGN PATENT DOCUMENTS

CN 1378005 A 11/2002
CN 1880543 A 12/2006
(Continued)

OTHER PUBLICATIONS

U.S. Patent Office; Office Action issued in U.S. Appl. No. 16/229,521 dated May 26, 2020.
(Continued)

*Primary Examiner* — Joseph L. Perrin
(74) *Attorney, Agent, or Firm* — Middleton Reutlinger

(57) ABSTRACT

A laundry washing machine and method automate the selection of a load type for a laundry washing machine during an initial fill phase of a wash cycle and based in part on weight and fluid level sensed by weight and fluid level sensors operatively coupled to a wash tub and after a selected amount of water has been dispensed into the wash tub.

20 Claims, 4 Drawing Sheets

(51) Int. Cl.

| | |
|---|---|
| ***D06F 39/08*** | (2006.01) |
| *D06F 103/02* | (2020.01) |
| *D06F 103/04* | (2020.01) |
| *D06F 103/06* | (2020.01) |
| *D06F 103/18* | (2020.01) |
| *D06F 105/02* | (2020.01) |
| *D06F 105/10* | (2020.01) |
| *D06F 105/48* | (2020.01) |
| *D06F 105/58* | (2020.01) |
| *D06F 101/00* | (2020.01) |
| *D06F 33/36* | (2020.01) |
| *D06F 33/38* | (2020.01) |
| *D06F 33/40* | (2020.01) |
| *D06F 33/00* | (2020.01) |

(52) U.S. Cl.

CPC ..... *D06F 33/36* (2020.02); *D06F 33/38* (2020.02); *D06F 33/40* (2020.02); *D06F 35/005* (2013.01); *D06F 39/088* (2013.01); *D06F 2101/00* (2020.02); *D06F 2103/02* (2020.02); *D06F 2103/04* (2020.02); *D06F 2103/06* (2020.02); *D06F 2103/18* (2020.02); *D06F 2105/02* (2020.02); *D06F 2105/10* (2020.02); *D06F 2105/48* (2020.02); *D06F 2105/58* (2020.02)

(56) References Cited

U.S. PATENT DOCUMENTS

| | | | |
|---|---|---|---|
| 4,986,093 | A | 1/1991 | Pastryk et al. |
| 4,987,627 | A | 1/1991 | Cur et al. |
| 5,031,427 | A | 7/1991 | Pastryk et al. |
| 5,161,393 | A | 11/1992 | Payne et al. |
| 5,167,722 | A | 12/1992 | Pastryk et al. |
| 5,373,714 | A | 12/1994 | Wada |
| 5,555,583 | A | 9/1996 | Berkcan |
| 5,560,060 | A | 10/1996 | Dausch et al. |
| 5,589,935 | A | 12/1996 | Biard |
| 5,603,233 | A | 2/1997 | Erickson et al. |
| 5,611,867 | A | 3/1997 | Cooper et al. |
| 5,731,868 | A | 3/1998 | Okey et al. |
| 5,737,790 | A | 4/1998 | Badger et al. |
| 5,768,729 | A | 6/1998 | Cracraft |
| 5,897,672 | A | 4/1999 | Badami et al. |
| 6,023,950 | A | 2/2000 | Battistella |
| 6,536,243 | B2 | 3/2003 | Sasano |
| 6,842,929 | B2 | 1/2005 | Kim et al. |
| 7,392,813 | B2 | 7/2008 | Bertram et al. |
| 7,421,752 | B2 | 9/2008 | Donadon et al. |
| 8,627,524 | B2 | 1/2014 | Urbanet et al. |
| 8,834,646 | B2 | 9/2014 | Bewley, Jr. |
| 8,910,335 | B2 | 12/2014 | Kim et al. |
| 9,139,946 | B2 | 9/2015 | Dogan et al. |
| 9,243,987 | B2 | 1/2016 | Chanda et al. |
| 2001/0002542 | A1 | 6/2001 | Sasano |
| 2003/0196278 | A1 | 10/2003 | Durfee |
| 2005/0022317 | A1 | 2/2005 | Shaffer |
| 2008/0276964 | A1 | 11/2008 | Hendrickson et al. |
| 2010/0095465 | A1 | 4/2010 | Kim et al. |
| 2012/0060299 | A1 | 3/2012 | Kim et al. |
| 2012/0103026 | A1 | 5/2012 | Oyama et al. |
| 2012/0312055 | A1 | 12/2012 | Fagstad et al. |
| 2013/0125595 | A1 | 5/2013 | Seo et al. |
| 2013/0312202 | A1 | 11/2013 | Balinski et al. |
| 2014/0259441 | A1 | 1/2014 | Fulmer et al. |
| 2014/0123403 | A1 | 5/2014 | Zattin et al. |
| 2014/0326067 | A1 | 11/2014 | Chanda et al. |
| 2015/0000047 | A1 | 1/2015 | Obregon |

FOREIGN PATENT DOCUMENTS

| | | | | |
|---|---|---|---|---|
| CN | 101935936 | A | 1/2011 | |
| CN | 102199854 | A | 9/2011 | |
| CN | 102199855 | A | 9/2011 | |
| CN | 102260981 | A | 11/2011 | |
| CN | 102465421 | A | 5/2012 | |
| CN | 103306096 | A | 9/2013 | |
| CN | 103334257 | | 10/2013 | |
| CN | 103334258 | | 10/2013 | |
| CN | 103485121 | A | 1/2014 | |
| CN | 203514043 | | 4/2014 | |
| CN | 103797175 | A | 5/2014 | |
| CN | 103898711 | | 7/2014 | |
| CN | 104233700 | A | 12/2014 | |
| CN | 104790179 | A | 7/2015 | |
| CN | 105063956 | | 11/2015 | |
| CN | 109477272 | A | 3/2019 | |
| CN | 109554889 | A | 4/2019 | |
| CN | 110512394 | A | 11/2019 | |
| DE | 2844755 | | 4/1980 | |
| DE | 102008055643 | A1 | 5/2010 | |
| DE | 102010029890 | A1 | 12/2011 | |
| EP | 0178031 | | 4/1986 | |
| EP | 0962576 | | 12/1999 | |
| EP | 2518203 | | 10/2012 | |
| EP | 2752514 | A1 * | 7/2014 | ..... D06F 33/00 |
| GB | 2262363 | | 6/1993 | |
| JP | 04054998 | A | 6/1990 | |
| JP | H0332699 | A | 2/1991 | |
| JP | H04122384 | A | 4/1992 | |
| JP | H06218183 | A | 8/1994 | |
| JP | H07171289 | A | 7/1995 | |
| JP | H08141273 | A | 6/1996 | |
| JP | 2011200526 | | 10/2011 | |
| KR | 20140019551 | A | 2/2014 | |
| WO | 2007003593 | | 1/2007 | |
| WO | WO2014205861 | A1 | 1/2016 | |
| WO | WO2018001077 | A1 | 1/2018 | |

OTHER PUBLICATIONS

Leveraging Lasers—Retrieved from: https://www.finisar.com/sites/default/files/resources/Appliance%20Design-VCSEL%20turbidity%20Sensor.pdf Dec. 21, 2015.

U.S. Patent Office; Office Action issued in U.S. Appl. No. 15/198,890 dated Feb. 9, 2018.

U.S. Patent Office; Restriction Requirement issued in U.S. Appl. No. 15/198,883 dated Jan. 18, 2018.

Transmittal of Related Applications.

U.S. Patent Office; Non-Final Office Action issued in U.S. Appl. No. 15/198,971 dated Apr. 2, 2018.

U.S. Patent Office; Restriction Requirement issued in U.S. Appl. No. 15/198,865 dated Mar. 27, 2018.

U.S. Patent Office; Office Action issued in U.S. Appl. No. 15/198,883 dated Apr. 20, 2018.

U.S. Patent Office; Office Action issued in U.S. Appl. No. 15/198,865 dated Jun. 13, 2018.

International Search Report and Written Opinion issued in Application No. PCT/CN2017/087805 dated Sep. 20, 2017.

International Search Report and Written Opinion issued in Application No. PCT/CN2017/087804 dated Sep. 4, 2017.

International Search Report and Written Opinion issued in Application No. PCT/CN2017/087800 dated Jul. 27, 2017.

International Search Report and Written Opinion issued in Application No. PCT/CN2017/087799 dated Sep. 13, 2017.

U.S. Patent Office; Final Office Action issued in U.S. Appl. No. 15/198,971 dated Oct. 9, 2018.

U.S. Patent Office; Notice of Allowance issued in U.S. Appl. No. 15/198,890 dated Sep. 6, 2018.

U.S. Patent Office; Notice of Allowance issued in U.S. Appl. No. 15/198,883 dated Sep. 12, 2018.

Transmittal of Related Applications dated Dec. 21, 2018.

U.S. Patent Office; Advisory Action issued in U.S. Appl. No. 15/198,971 dated Jan. 22, 2019.

U.S. Patent Office; Notice of Allowance issued in U.S. Appl. No. 15/198,865 dated Jan. 24, 2019.

U.S. Patent Office; Notice of Allowance issued in U.S. Appl. No. 15/198,971 dated Mar. 7, 2019.

(56) References Cited

OTHER PUBLICATIONS

U .S. Patent Office; Notice of Allowance issued in U.S. Appl. No. 16/229,521 dated Nov. 3, 2020.
International Search Report and Written Opinion issued in Application No. PCT/CN2021/098144 dated Aug. 30, 2021.

* cited by examiner

LAUNDRY WASHING MACHINE WITH AUTOMATIC SELECTION OF LOAD TYPE

CROSS-REFERENCE TO RELATED APPLICATIONS

This application is a division of U.S. patent application Ser. No. 15/198,865 filed on Jun. 30, 2016 entitled "LAUNDRY WASHING MACHINE WITH AUTOMATIC SELECTION OF LOAD TYPE," which is related to the following applications: U.S. patent application Ser. No. 15/198,883 filed Jun. 30, 2016 entitled "LAUNDRY WASHING MACHINE WITH AUTOMATIC DETERGENT DISPENSING AND/OR RINSE OPERATION TYPE SELECTION," U.S. patent application Ser. No. 15/198,890 filed Jun. 30, 2016 entitled "LAUNDRY WASHING MACHINE WITH AUTOMATIC DETECTION OF DETERGENT DEFICIT," and U.S. patent application Ser. No. 15/198,971 filed Jun. 30, 2016 entitled "LAUNDRY WASHING MACHINE WITH AUTOMATIC RINSE OPERATION TYPE SELECTION." The disclosures of each of these applications are incorporated by reference herein.

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. The settings cycle can have an appreciable effect on washing performance, as well as on energy and/or water consumption, so it is generally desirable for the settings used by a laundry washing machine to appropriately match the needs of each load washed by the machine.

Some laundry washing machines also support user selection of load types, typically based on the types of fabrics and/or items in the load. Some laundry washing machines, for example, have load type settings such as colors, whites, delicates, cottons, permanent press, towels, bedding, heavily soiled items, etc. These manually-selectable load types generally represent specific combinations of settings that are optimized for particular load types so that a user is not required to select individual values for each of the controllable settings of a laundry washing machine.

While manual load type selection in many cases simplifies a user's interaction with a laundry washing machine, such manual selection still can lead to suboptimal performance due to, for example, user inattentiveness or lack of understanding. Therefore, a significant need continues to exist in the art for a manner of optimizing the performance of a laundry washing machine for different types of loads, as well as reducing the burden on users when interacting with a laundry washing machine.

SUMMARY

The invention addresses these and other problems associated with the art by providing a laundry washing machine and method that automate the selection of a load type for a laundry washing machine during an initial fill phase of a wash cycle and based in part on weight and fluid level sensed by weight and fluid level sensors operatively coupled to a wash tub and after a selected amount of water has been dispensed into the wash tub.

In some embodiments of the invention, for example, a laundry washing machine includes a wash tub disposed within a housing, a water inlet configured to dispense water into the wash tub, a weight sensor operatively coupled to the wash tub to sense a weight associated with the wash tub, a fluid level sensor configured to sense a fluid level in the wash tub, and a controller coupled to the water inlet and the weight and fluid level sensors. The controller is configured to initiate an initial fill phase of a wash cycle by controlling the water inlet to dispense water into the wash tub and to dynamically select a load type from among a plurality of load types during the initial fill phase of a wash cycle based upon weight and fluid level values sensed respectively by the weight and fluid level sensors after a selected amount of water has been dispensed by the water inlet.

In some embodiments, the load type is dynamically selected by controlling the water inlet to dispense the selected amount of water into the wash tub, determining one or more water absorption parameters for the load using the weight and fluid level values sensed respectively by the weight and fluid level sensors, and selecting the load type based upon the determined one or more water absorption parameters. Further, in some embodiments, the one or more water absorption parameters for the load are determined by determining a first water absorption parameter for the load based upon the weight value sensed by the weight sensor after the selected amount of water is dispensed into the wash tub and determining a second water absorption parameter for the load based upon the fluid level value sensed by the fluid level sensor after the amount of water is dispensed into the wash tub.

In addition, in some embodiments, the load type is selected by comparing the first and second water absorption parameters with a plurality of constants associated with the plurality of load types. Further, some embodiments determine an amount of water dispensed into the wash tub based upon an amount of time that the controller controls the water inlet to dispense water into the wash tub, while some embodiments determine an amount of water dispensed into the wash tub based on a flow of water sensed by a flow sensor.

In some embodiments, the selected amount of water is less than a total amount of water dispensed during the initial fill phase, and the load type is selected prior to completing the initial fill phase. Further, in some embodiments, the load type is selected while pausing dispensing of water by the water inlet, and in some embodiments, a plurality of fluid level values sensed by the fluid level sensor while pausing dispensing of water by the water inlet are determined, and the load type is selected based upon the plurality of fluid level values. In addition, in some embodiments, the load type is selected while controlling the water inlet to dispense water, and in some embodiments, weight and fluid level values are determined at a plurality of amounts of water dispensed by the water inlet, and the load type is selected based upon the determined weight and fluid level values at the plurality of amounts of water dispensed by the water inlet.

In some embodiments, the load type is selected prior to agitating the load and prior to draining fluid from the wash tub, and in some embodiments, a wash or rinse temperature, a wash or rinse water amount, an agitation duration, an agitation stroke, a soak duration, a spin speed, a spin duration, a cycle time, or a number of phase repeats are controlled in response to the selected load type. Further, in some embodiments, the weight sensor includes a load cell coupled to a suspension system for the wash tub, the fluid level sensor includes a pressure sensor in fluid communication with the wash tub, and the fluid level value includes a pressure value. Further, in some embodiments a dry weight of the load may be determined using the weight sensor prior to controlling the water inlet to dispense the selected amount of water into the wash tub, and the load type may be selected further based upon the dry weight of the load.

Other embodiments may include a method of operating a laundry washing machine of the type including a wash tub disposed within a housing and a water inlet configured to dispense water into the wash tub. The method may include initiating an initial fill phase of a wash cycle by controlling the water inlet to dispense a selected amount of water into the wash tub, sensing a weight value associated with the wash tub with a weight sensor operatively coupled to the wash tub after the selected amount of water has been dispensed by the water inlet, sensing a fluid level value with a fluid level sensor that senses fluid level in the wash tub after the selected amount of water has been dispensed by the water inlet, and dynamically selecting a load type from among a plurality of load types during the initial fill phase of the wash cycle based upon the weight and fluid level values.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
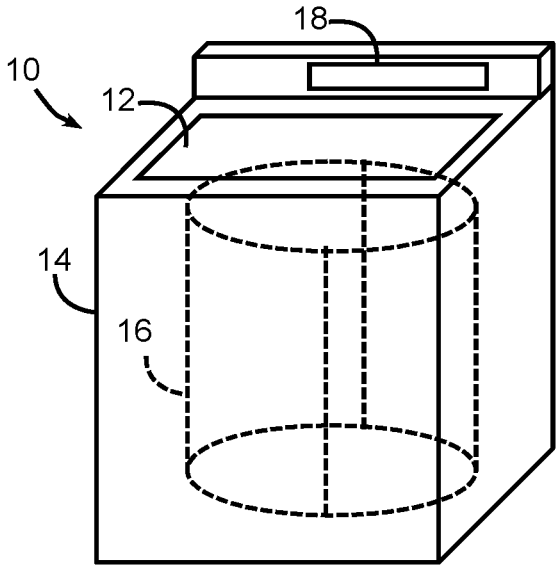
FIG. 1 is a perspective view of a top-load laundry washing machine consistent with some embodiments of the invention.

Embodiments consistent with the invention may be used to automate the selection of a load type for a laundry washing machine. In particular, in some embodiments consistent with the invention, a laundry washing machine may include in part a weight sensor operatively coupled to a wash tub to sense a weight associated with the wash tub, a fluid level sensor configured to sense a fluid level in the wash tub and a controller configured to initiate an initial fill phase of a wash cycle by controlling a water inlet to dispense a selected amount of water into the wash tub and to dynamically select a load type from among a plurality of load types during the initial fill phase based upon weight and fluid level values sensed respectively by the weight and fluid level sensors after the selected amount of water has been dispensed by the water inlet.

In this regard, a load type may be considered to represent one of a plurality of different characteristics, categories, classes, subclasses, etc. that may be used to distinguish different loads from one another, and for which it may be desirable to define particular operational settings or combinations of operational settings for use in washing loads of that particular load type. Load types may be defined, for example, to distinguish between colors, darks, whites, etc.; between different fabric types (e.g., natural, cotton, wool, silk, synthetic, polyester, permanent press, wrinkle resistant, blends, etc.); between different article types (e.g., garments, towels, bedding, delicates, etc.); between lightly, normally or heavily soiled loads; etc. Load types may also represent categories of loads that are unnamed, and that simply represent a combination of characteristics for which certain combinations operational settings may apply, particularly as it will be appreciated that some loads may be unsorted and may include a combination of different items that themselves have different characteristics. Therefore, in some embodiments, a load type may be associated with a combination of operational settings that will be applied to a range of different loads that more closely match that load type over other possible load types.

An operational setting, in this regard, may include any number of different configurable aspects of a wash cycle performed by a laundry washing machine including, but not limited to, a wash water temperature, a rinse water temperature, a wash water amount, a rinse water amount, a speed or stroke of agitation during washing and/or rinsing, a spin speed, whether or not agitation is used during washing and/or rinsing, a duration of a wash, rinse, soak, or spin phase of a wash cycle, a number of repeats of a wash, rinse, soak or spin phase, selection between different rinse operation types such as a spray rinse operation or a deep fill rinse operation, pre-treatment such as soaking over time with a prescribed water temperature and specific agitation stroke, etc.

As will become more apparent below, in various embodiments of the invention, a load type may be dynamically selected during an initial fill phase of a wash cycle, i.e., the phase of a wash cycle in which water is first introduced into a wash tub, and generally prior to any agitation of the load and/or draining of fluid from the wash tub, and generally without any extended soaking of the load. Thus, in contrast to some conventional approaches, load type selection may be performed with little or no delay in the initial fill phase, and thus, with little or no impact on the duration of the overall wash cycle.

Further, the dynamic selection is based at least in part upon weight and fluid level values sensed respectively by weight and fluid level sensors operatively coupled to sense a weight and a fluid level in a wash tub after a selected amount of water has been dispensed into the wash tub. It will be appreciated that water is naturally absorbed into the garments and/or other items in a load as water in introduced into a wash tub, and that certain types and mixes of garments and items will absorb water at different rates and will displace water at different amounts. It has been found that through the use of a combination of weight and fluid level measurements, different types of loads may be distinguished because the fluid level will generally indicate the amount of displacement of the load in the wash tub as well as give an effective absorption of water when comparing to the weight. Various algorithms as discussed below may incorporate both weight and fluid level values to effectively distinguish the load type based on different major groupings and their associated load weights, rates of absorption and effective water displacements.

In some embodiments, for example, weight and fluid level values may be used to determine characteristics associated with the water absorption properties of the load, i.e., the degree to which and/or rate of which water (or any other fluid) is absorbed into the items constituting the load. In some embodiments, for example, weight and fluid level values may be used to determine first and second water absorption parameters that are each compared to empirically-determined constants associated with different load types in order to select a load type among the different load types that most closely matches the water absorption parameters.

Numerous variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
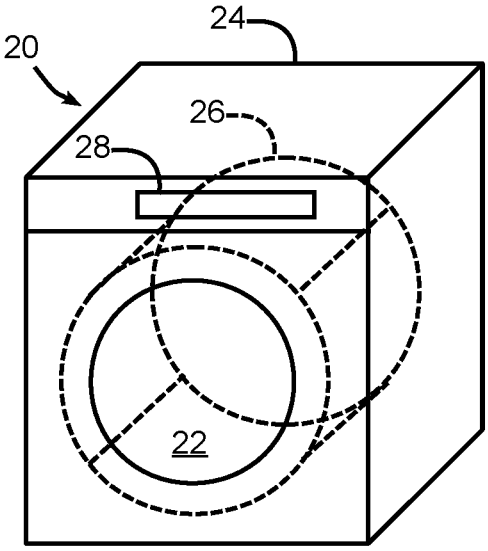
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques within a front-load laundry washing machine would be well within the abilities of one of ordinary skill in the art having the benefit of the instant disclosure, so the invention is not limited to the top-load implementation discussed further herein.

Figure 3:
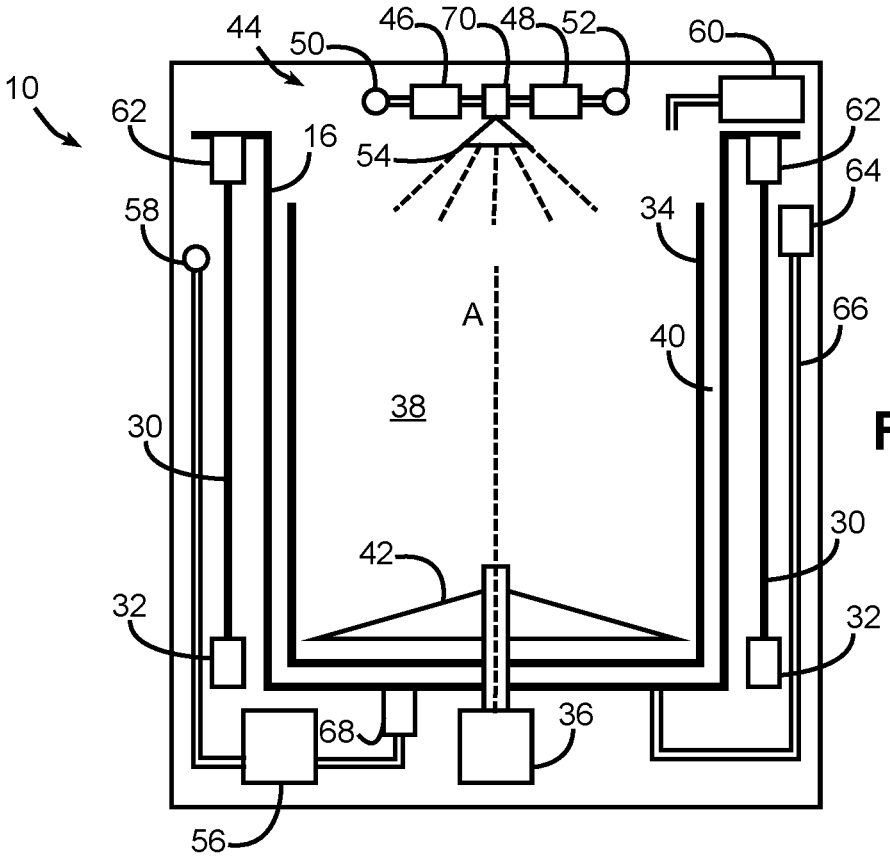
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, in some embodiments an agitator 42 such as an impeller, auger or other agitation element may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16.

In some embodiments, laundry washing machine 10 may also include a dispensing system 60 configured to dispense detergent, fabric softener and/or other wash-related products into wash tub 16. Dispensing system 60 may be configured in some embodiments to dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Further, to support automatic load type selection consistent with the invention, laundry washing machine 10 also includes at least a weight sensor and a fluid level sensor. A weight sensor may be used to generate a signal that varies based in part on the mass or weight of the contents of wash tub 16. In the illustrated embodiment, for example, a weight sensor may be implemented in laundry washing machine 10 using one or more load cells 62 that support wash tub 16 on one or more corresponding support rods 30. Each load cell 62 may be an electro-mechanical sensor that outputs a signal that varies with a displacement based on load or weight, and thus outputs a signal that varies with the weight of the contents of wash tub 16. Multiple load cells 62 may be used in some embodiments, while in other embodiments, other types of transducers or sensors that generate a signal that varies with applied force, e.g., strain gauges, may be used. Furthermore, while load cells 62 are illustrated as supporting wash tub 16 on support rods 30, the load cells, or other appropriate transducers or sensors, may be positioned elsewhere in a laundry washing machine to generate one or more signals that vary in response to the weight of the contents of wash tub 16. In some embodiments, for example, transducers may be used to support an entire load washing machine, e.g., one or more feet of a machine. Other types and/or locations of transducers suitable for generating a signal that varies with the weight of the contents of a wash tub will be apparent to one of ordinary skill in the art having the benefit of the instant disclosure. In addition, in some embodiments, a weight sensor may also be used for vibration sensing purposes, e.g., to detect excessive vibrations resulting from an out-of-balance load. In other embodiments, however, no vibration sensing may be used, while in other embodiments, separate sensors may be used to sense vibrations.

A fluid level sensor may be used to generate a signal that varies with the level or height of fluid in wash tub 16. In the illustrated embodiment, for example, a fluid level sensor may be implemented using a pressure sensor 64 in fluid communication with a low point, bottom or sump of wash tub 16 through a tube 66 such that a pressure sensed by pressure sensor 64 varies with the level of fluid within the wash tub, as it will be understood that the addition of fluid to the wash tub will generate a hydrostatic pressure within the tube that varies with the level of fluid in the wash tub, and that may be sensed, for example, with a piezoelectric or other transducer disposed on a diaphragm or other movable element. It will be appreciated that a wide variety of pressure sensors may be used to provide fluid level sensing, including, among others, combinations of pressure switches that trigger at different pressures. It will also be appreciated that fluid level in the wash tub may also be sensed using various non-pressure based sensors, e.g., optical sensors, laser sensors, etc.

Additional sensors may also be incorporated into laundry washing machine 10. For example, in some embodiments, a turbidity sensor 68 may be used to measure the turbidity or clarity of the fluid in wash tub 16, e.g., to sense the presence or relative amount of various wash-related products such as detergents or fabric softeners and/or to sense the presence or relative amount of soil in the fluid. Further, in some embodiments, turbidity sensor 68 may also measure other characteristics of the fluid in wash tub 16, e.g., conductivity and/or temperature. In other embodiments, separate sensors may be used to measure turbidity, conductivity and/or temperature, and further, other sensors may be incorporated to measure additional fluid characteristics. In other embodiments, no turbidity sensor may be used.

In addition, in some embodiments, a flow sensor 70 such as one or more flowmeters may be used to sense an amount of water dispensed into wash tub 16. In other embodiments, however, no flow sensor may be used. Instead, water inlet 44 may be configured with a static and regulated flow rate such that the amount of water dispensed is a product of the flow rate and the amount of time the water is dispensed. Therefore, in some embodiments, a timer may be used to determine the amount of water dispensed into wash tub 16.

Figure 4:
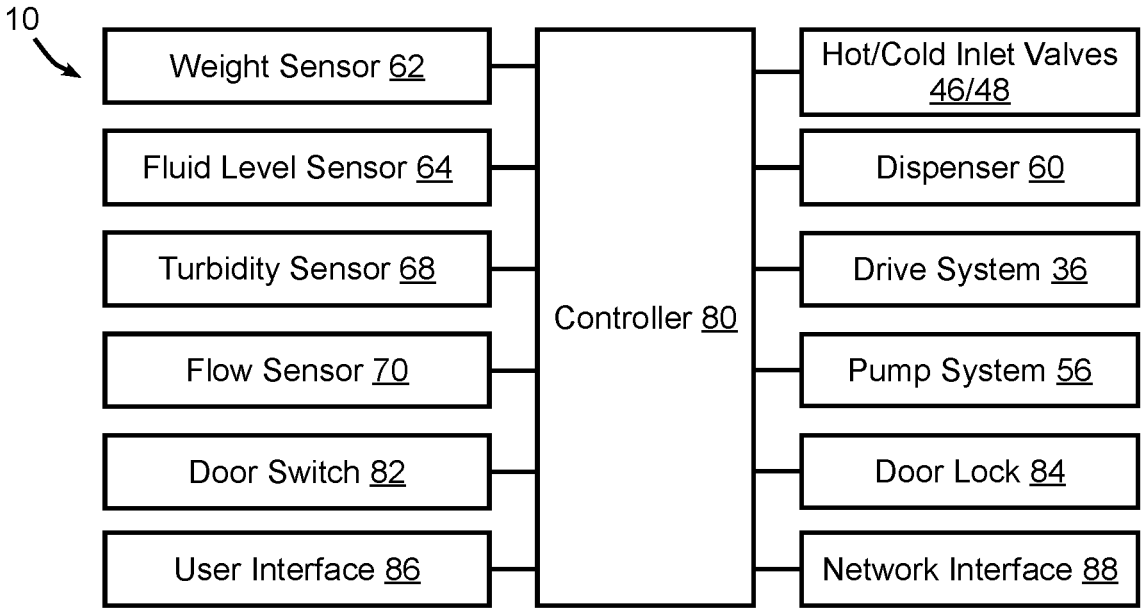
FIG. 4 is a block diagram of an example control system for the laundry washing machine of FIG. 1.

Now turning to FIG. 4, laundry washing machine 10 may be under the control of a controller 80 that receives inputs from a number of components and drives a number of components in response thereto. Controller 80 may, for example, include one or more processors and a memory (not shown) within which may be stored program code for execution by the one or more processors. The memory may be embedded in controller 80, but may also be considered to include volatile and/or non-volatile memories, cache memories, flash memories, programmable read-only memories, read-only memories, etc., as well as memory storage physically located elsewhere from controller 80, e.g., in a mass storage device or on a remote computer interfaced with controller 80.

As shown in FIG. 4, controller 80 may be interfaced with various components, including the aforementioned drive system 36, hot/cold inlet valves 46, 48, pump system 56, weight sensor 62, fluid flow sensor 64, turbidity sensor 68, and flow sensor 70. In addition, controller 80 may be interfaced with additional components such as a door switch 82 that detects whether door 12 is in an open or closed position and a door lock 84 that selectively locks door 12 in a closed position. Moreover, controller 80 may be coupled to a user interface 86 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 80 may also be coupled to one or more network interfaces 88, e.g., for interfacing with external devices via wired and/or wireless networks such as Ethernet, Bluetooth, NFC, cellular and other suitable networks. Additional components may also be interfaced with controller 80, as will be appreciated by those of ordinary skill having the benefit of the instant disclosure. Moreover, in some embodiments, at least a portion of controller 80 may be implemented externally from a laundry washing machine, e.g., within a mobile device, a cloud computing environment, etc., such that at least a portion of the functionality described herein is implemented within the portion of the controller that is externally implemented.

In some embodiments, controller 80 may operate under the control of an operating system and may execute or otherwise rely upon various computer software applications, components, programs, objects, modules, data structures, etc. In addition, controller 80 may also incorporate hardware logic to implement some or all of the functionality disclosed herein. Further, in some embodiments, the sequences of operations performed by controller 80 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 5:
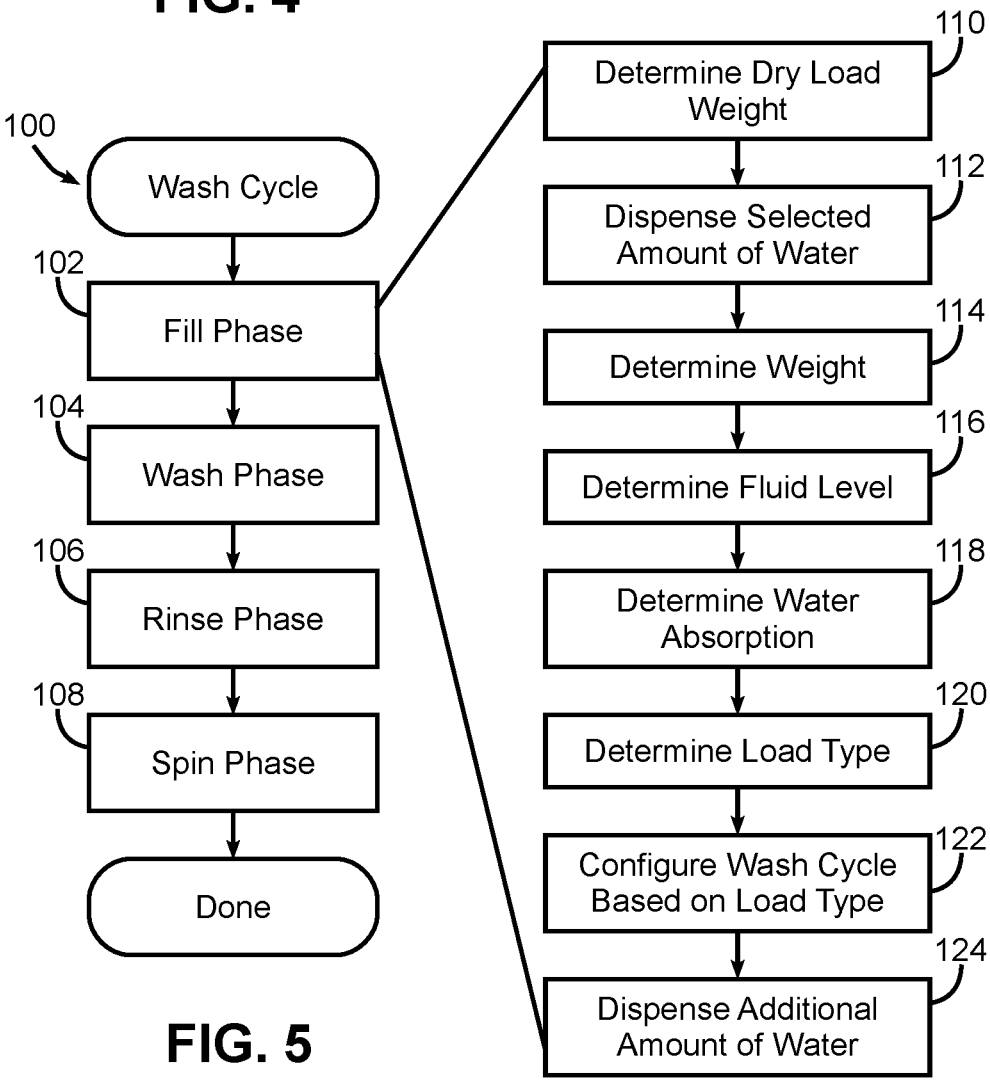
FIG. 5 is a flowchart illustrating an example sequence of operations for implementing a wash cycle in the laundry washing machine of FIG. 1.

Now turning to FIG. 5, and with continuing reference to FIGS. 3-4, a sequence of operations 100 for performing a wash cycle in laundry washing machine 10 is illustrated. A typical wash cycle includes multiple phases, including an initial fill phase 102 where the wash tub is initially filled with water, a wash phase 104 where a load that has been placed in the wash tub is washed by agitating the load with a wash liquor formed from the fill water and any wash products added manually or automatically by the washing machine, a rinse phase 106 where the load is rinsed of detergent and/or other wash products (e.g., using a deep fill rinse where the wash tub is filled with fresh water and the load is agitated and/or a spray rinse where the load is sprayed with fresh water while spinning the load), and a spin phase 108 where the load is spun rapidly while water is drained from the wash tub to reduce the amount of moisture in the load.

It will be appreciated that wash cycles can also vary in a number of respects. For example, additional phases, such as a pre-soak phase, may be included in some wash cycles, and moreover, some phases may be repeated, e.g., including multiple rinse and/or spin phases. Each phase may also have a number of different operational settings that may be varied for different types of loads, e.g., different times or durations, different water temperatures, different agitation speeds or strokes, different rinse operation types, different spin speeds, different water amounts, different wash product amounts, etc.

In embodiments consistent with the invention, a load type may be automatically selected during the initial fill phase 102 based in part on weight and fluid level values sensed respectively by the weight and fluid level sensors 62, 64 after a selected amount of water has been dispensed by water inlet 44. In some embodiments, the automatic selection may be performed in response to selection of a particular mode (e.g., an "automatic" mode), while in other embodiments, automatic selection may be used for all wash cycles.

In some embodiments, the load type may be selected from among a plurality of different load types based in part of dry load weight and one or more water absorption parameters for the load determined from sensed weight and fluid level. Blocks 110-124, for example, illustrate one example sequence of operations for performing automatic load type selection in some embodiments of the invention. In block 110, a dry load weight is determined, e.g., by determining a weight value from weight sensor 62 prior to introducing water into wash tub 16. The dry weight may be calculated, for example, by subtracting from the weight sensed by weight sensor 62, the weight of wash tub 16 when empty (e.g., as stored in a memory or measured prior to placement of the load in the wash tub).

Next, in block 112, a selected amount of water is dispensed, e.g., by controlling valves 46, 48 of water inlet 44 to dispense a selected, e.g., a known, preset or predetermined, amount of water into the wash tub. In some embodiments, the amount of water may be determined by monitoring flow sensor 70, while in other embodiments, the amount of water may be determined by monitoring the fill duration and multiplying by a known flow rate of the water inlet 44.

Blocks 114-116 next determine weight and fluid level values based upon outputs of the weight and fluid level sensors 62, 64 after the selected amount of water has been dispensed into the wash tub. In some embodiments, dispensing of water by water inlet 44 may be paused at least momentarily prior to sensing the weight and fluid level and/or selecting a load type, while in some embodiments, the dispensing of water may be continued during the determination of weight and fluid level and/or selection of load type.

In some embodiments, weight and fluid level values determined in blocks 114 and 116 may be correlated or otherwise associated with the selected amount of dispensed water. Further, in some embodiments, the weight and fluid level values may be correlated to the same amount of dispensed water, while in other embodiments, the weight and fluid level values may be correlated to different amounts of dispensed water, i.e., the weight and fluid level may be measured after different amounts of water have been dispensed into the wash tub. Further, as will become more apparent below, in some embodiments multiple weight and/or fluid level values may be collected and correlated with multiple amounts of dispensed water.

Next, in block 118, one or more water absorption parameters is calculated, e.g., based upon the weight and fluid level values, the dry weight of the load, and the amount of dispensed water, and then in block 120, a load type is determined based upon the one or more determined water absorption parameters.

In one embodiment, for example, one type of water absorption parameter, referred to herein as a combined water absorption parameter, may be calculated using Eq. (1) below:

$$M_T = f\left(\mathrm{Lim}_{0\to X}\%M_T LC, \mathrm{Lim}_{0\to X}\%M_T PS\right) \quad (1)$$

where X represents time, $M_T$ is the combined water absorption parameter, $\mathrm{Lim}_{0\to X}\%M_T LC$ is a load cell-based water absorption limit parameter using a load cell-measured representation of the water content retained in the load items, and $\mathrm{Lim}_{0\to X}\%M_T PS$ is a pressure sensor-based water absorption limit parameter using a pressure sensor-measured representation of the water retained in the load items.

In addition, in this embodiment, each load type among multiple supported load types may be associated with a constant (e.g., a single value or a range of values) that may be determined empirically for that load type, such that a comparison of a water absorption parameter such as the aforementioned combined water absorption parameter with the constants associated with the different load types may be used to select a matching load type for the load. Further, each load type may be associated with additional constants, e.g., based upon dry load weight, such that selection of a matching load type may be based on multiple parameters or values.

It will be appreciated that in some embodiments, different load types may have overlapping characteristics and constants such that determination of a load type based upon one or more water absorption parameters may present a nonlinear system, and as such, various nonlinear solution techniques, e.g., fuzzy logic, artificial neural networks, etc. may be used to select a load type based upon one or more water absorption parameters.

Once a load type is selected in block 120, block 122 next configures the wash cycle based on the selected load type. For example, each load type may be associated with a set of operational settings stored in controller 80 such that selection of a particular load type causes controller 80 to access the set of operational settings for the selected load type when completing the remainder of the wash cycle.

Next, block 124 dispenses an additional amount of water to complete the fill cycle. For example, the additional amount of water may be selected to provide a total amount of dispensed water selected based upon load type or selected via a separate load size selection by the user. In other embodiments, the amount of water dispensed in block 112 may be the total amount of water dispensed during the fill phase, and block 124 may be omitted. Nonetheless, in some embodiments, even when no additional water is dispensed after selecting load type, the load type is selected prior to transitioning to the wash phase, and thus prior to any agitation of the load and/or draining of fluid from the wash tub. Furthermore, it will be appreciated that the amount of time expended selecting the load type may be minimal or even imperceptible in some embodiments.

Figure 6:
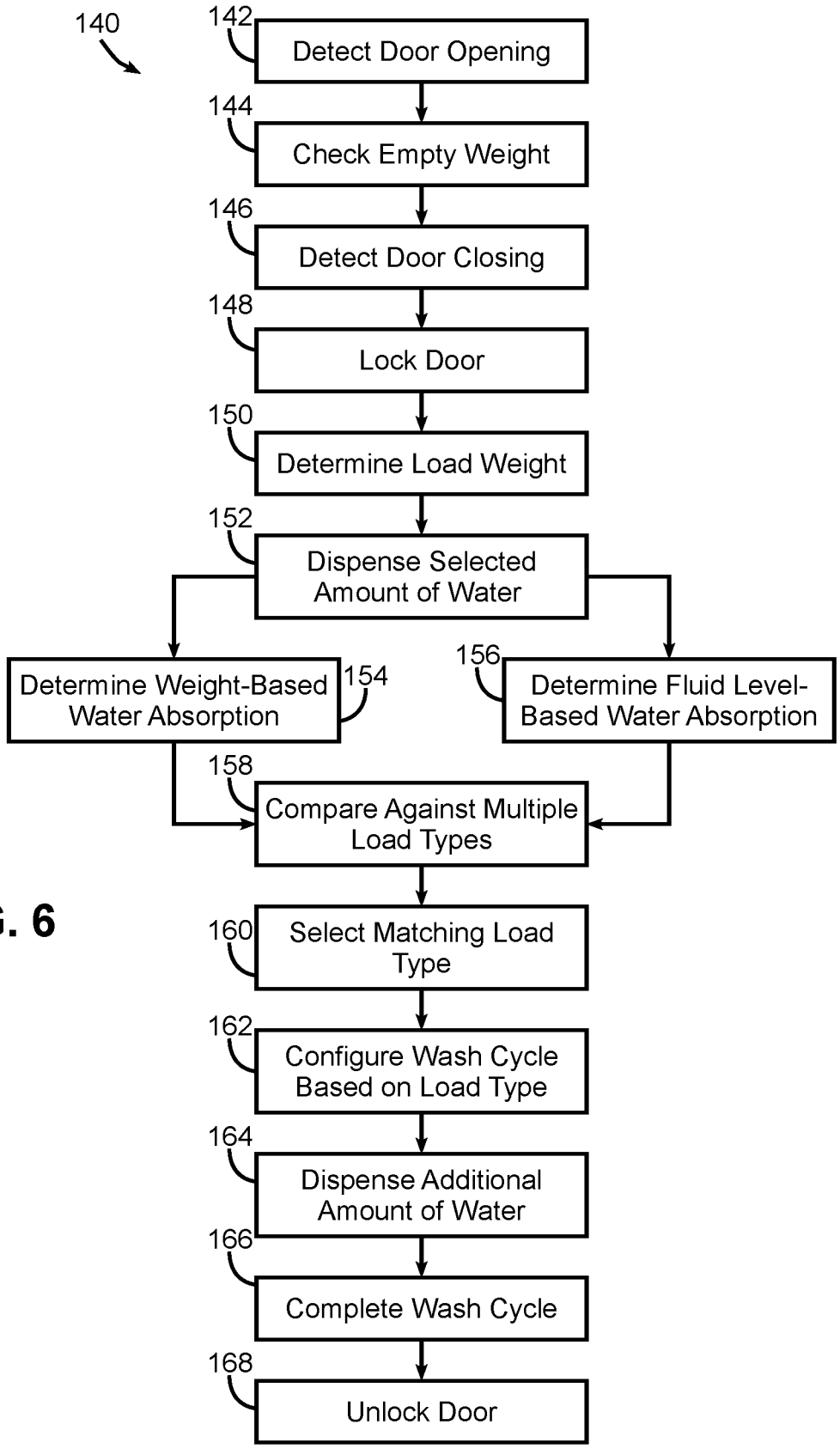
FIG. 6 is a flowchart illustrating another example sequence of operations for implementing a wash cycle in the laundry washing machine of FIG. 1.

FIG. 6 next illustrates another sequence of operations 140 that may be used to implement a wash cycle with automatic load type selection consistent with the invention. Block 142 initially detects opening of the washing machine door, e.g., using door switch 82, and upon opening, block 144 determines a tare weight assuming wash tub 16 is empty using weight sensor 62.

Block 146 then detects the door closing using door switch 82. Block 146 may also check the output of weight sensor 62 to determine that a load has been placed in the wash tub, and then pass control to block 148 to initiate actuation of door lock 84 to lock the door. A safety algorithm may also be performed at this time to determine whether the machine is able to proceed with a wash cycle. Next, block 150 determines the load weight using weight sensor 62 and the tare weight determined in block 144.

Block 152 next controls water inlet 44 to dispense a selected amount of water, and blocks 154 and 156, which may be executed sequentially in either order or in parallel, and which may be executed during a pause in the dispensing of water or concurrently with dispensing additional water, determine respective weight-based and fluid level-based water absorption parameters, e.g., using Eqs. (2) and (3) below, which may then be used to generate the $M_T$ combined water absorption parameter as described above in connection with Eq. (1):

$$\mathrm{Lim}_{0\to X}\%M_T LC=(W_{1X}+W_{2X}-W_{0X})/(W_{1X}+W_{2X})*100 \quad (2)$$

$$\mathrm{Lim}_{0\to X}\%M_T PS=(PS_{1X}+PS_{2X}-PS_{0X})/(PS_{1X}+PS_{2X})*100 \quad (3)$$

where X represents time, $\mathrm{Limo}_{0\to X}\%M_T\mathrm{LC}$ is a type of weight-based water absorption parameter referred to herein as a load cell-based water absorption limit parameter using a load cell-measured representation of the water content retained in the load items, $\mathrm{Lim}_{0\to X}\%M_T\mathrm{PS}$ is a type of fluid level-based water absorption parameter referred to herein as a pressure sensor-based water absorption limit parameter using a pressure sensor-measured representation of the water retained in the load items, $W_0$ represents a dry load weight, $W_1$ represents a weight of water and load, $W_2$ represents a weight of the boundary water (i.e., water that does not touch the load and has no chance to absorb, $PS_0$ represents a volume of water dispensed, $PS_1$ represents a volume of water detected, and $PS_2$ represents a volume of the boundary water (i.e., water that does not touch the load and has no chance to absorb). It will be appreciated that, in some embodiments, one or more of the above values may be estimated based upon the geometry of a particular wash tub design and/or other design aspects of a particular washing machine design. Further, it will be appreciated that, in some embodiments, empirical testing may be used to derive the functions for any of the aforementioned water absorption parameters for particular washing machine designs relative to weight and fluid level sensor outputs.

In addition, in this embodiment, each load type among multiple supported load types may be associated with a constant (e.g., a single value or a range of values) for each of the weight-based and fluid level-based water absorption parameters (e.g., the aforementioned load cell-based and pressure sensor-based water absorption limit parameters) that may be determined empirically for that load type, and such that a comparison of the weight-based and fluid level-based water absorption parameters with the constants associated with the different load types may be used to select a matching load type for the load. As such, block 158 compares these parameters against multiple load types, and block 160 selects a matching load type based upon the comparison.

Then, once a load type is selected, block 162 configures the wash cycle based on the selected load type and block 164 optionally dispenses an additional amount of water to complete the fill cycle, similar to blocks 122 and 124. The wash cycle is then completed in block 166 using the operational settings associated with the selected load type, and upon completion of the wash cycle, the door is unlocked in block 168 by deactivating door lock 84.

It will be appreciated that automatic load type selection may be implemented in a number of other manners in other embodiments. For example, different equations may be used in other embodiments to represent different relationships between load type and load weight, fluid level, water absorption, and/or water absorption rate. In addition, it will be appreciated that while parameters and values are described in the illustrated embodiments in terms of weights, fluid levels, absorbency, etc., the actual parameters or values need not correspond to particular dimensions of weight, mass, volume, length, etc., as it is generally the fact that different loads have different relative weights, absorbencies, absorbency rates and other characteristics that may be utilized to categorize loads into different load types. For example, in the case of fluid level sensor 64 implemented using a pressure sensor, it is generally not necessary to convert a pressure value sensed by the sensor into any particular units of pressure, or even into any particular level, height, or volume of water in the wash tub that is represented by the sensor output. As such, various equations that distinguish between different load types based upon the outputs of weight and fluid level sensors will be envisioned by those of ordinary skill the art having the benefit of the instant disclosure.

Further, multiple values of weight and/or fluid level may be collected at different times and/or after dispensing different amounts of water, and may be used to determine load type in different embodiments. In some embodiments, for example, water absorbency rate may be determined in part by determining multiple fluid level values sensed by the fluid level sensor while pausing dispensing of water by water inlet 44, with a decrease in fluid level being seen as water is absorbed into the load.

Figure 7:
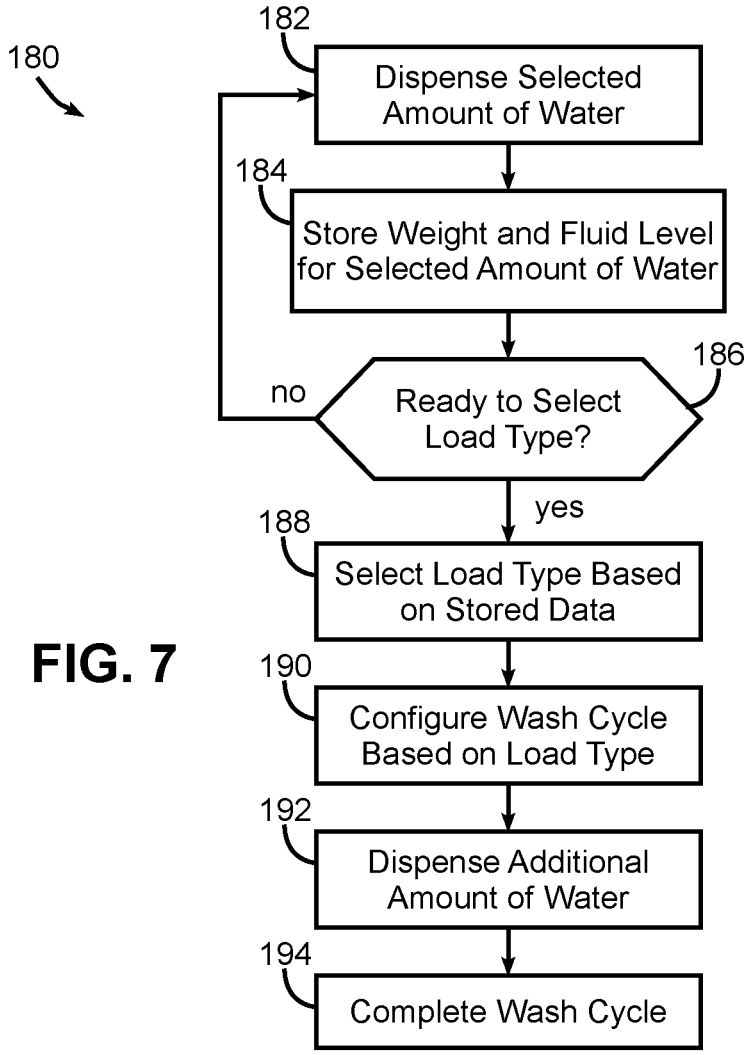
FIG. 7 is a flowchart illustrating another example sequence of operations for implementing a wash cycle in the laundry washing machine of FIG. 1.

As another example, FIG. 7 illustrates another sequence of operations 180 for performing a wash cycle that performs a loop in blocks 182-186 to dispense selected amounts of water (block 182) and periodically store weight and fluid level values collected from sensors 62, 64 correlated with each selected amount of water (block 184). Once a sufficient amount of data is collected, block 186 may then pass control to block 188 to select the load type based on the stored data, e.g., using any of the various manners discussed above, or in other manners that will be apparent to those of ordinary skill in the art having the benefit of the instant disclosure. Thereafter, block 190 may configure the wash cycle based on the selected load type, block 192 may optionally dispense an additional amount of water to complete the fill phase, and block 194 may complete the remainder of the wash cycle based upon operational settings for the selected load type.

Various additional modifications may be made to the illustrated embodiments consistent with the invention. Therefore, the invention lies in the claims hereinafter appended.

What is claimed is:

1. A method of operating a laundry washing machine of the type including a wash tub disposed within a housing and a water inlet configured to dispense water into the wash tub, the method comprising:

initiating an initial fill phase of a wash cycle by controlling the water inlet to dispense a selected amount of water into the wash tub;

sensing a weight value associated with the wash tub with a weight sensor operatively coupled to the wash tub after the selected amount of water has been dispensed by the water inlet;

sensing a fluid level value with a fluid level sensor that senses fluid level in the wash tub after the selected amount of water has been dispensed by the water inlet; and dynamically selecting a load type from among a plurality of load types during the initial fill phase of the wash cycle and prior to agitating the load based upon the weight and fluid level values.

2. The method of claim 1, wherein dynamically selecting the load type includes:

controlling the water inlet to dispense the selected amount of water into the wash tub;

determining a water absorption parameter for the load using the weight and fluid level values sensed respectively by the weight and fluid level sensors; and selecting the load type based upon the determined water absorption parameter.

3. The method of claim 2, wherein determining the water absorption parameter for the load includes:

determining a first water absorption parameter for the load based upon the weight value sensed by the weight sensor after the selected amount of water is dispensed into the wash tub; and determining a second water absorption parameter for the load based upon the fluid level value sensed by the fluid level sensor after the amount of water is dispensed into the wash tub.

4. The method of claim 3, wherein selecting the load type includes comparing the first and second water absorption parameters with a plurality of constants associated with the plurality of load types.

5. The method of claim 1, wherein the selected amount of water is less than a total amount of water dispensed during the initial fill phase, and wherein selecting the load type is performed prior to completing the initial fill phase.

6. The method of claim 5, wherein selecting the load type is performed while dispensing of water by the water inlet is paused.

7. The method of claim 6, further comprising determining a plurality of fluid level values sensed by the fluid level sensor while pausing dispensing of water by the water inlet, wherein selecting the load type is based upon the plurality of fluid level values.

8. The method of claim 5, wherein selecting the load type is performed while controlling the water inlet to dispense water.

9. The method of claim 1, wherein selecting the load type is performed prior to agitating the load and prior to draining fluid from the wash tub.

10. The method of claim 1, further comprising control a wash or rinse temperature, a wash or rinse water amount, an agitation duration, an agitation stroke, a soak duration, a spin speed, a spin duration, a cycle time, or a number of phase repeats in response to the selected load type.

11. The method of claim 1, further comprising determining a dry weight of the load using the weight sensor prior to controlling the water inlet to dispense the selected amount of water into the wash tub, wherein selecting the load type is further based upon the dry weight of the load.

12. A method of operating a laundry washing machine of the type including a wash tub disposed within a housing and a water inlet configured to dispense water into the wash tub, the method comprising:

initiating an initial fill phase of a wash cycle by controlling the water inlet to dispense a selected amount of water into the wash tub;

sensing a weight value associated with the wash tub with a weight sensor operatively coupled to the wash tub after the selected amount of water has been dispensed by the water inlet;

sensing a fluid level value with a fluid level sensor that senses fluid level in the wash tub after the selected amount of water has been dispensed by the water inlet; and dynamically selecting a load type from among a plurality of load types during the initial fill phase of the wash cycle based upon the weight and fluid level values, wherein dynamically selecting the load type includes:

controlling the water inlet to dispense the selected amount of water into the wash tub;

determining a first water absorption parameter for the load based upon the weight value sensed by the weight sensor after the selected amount of water is dispensed into the wash tub;

determining a second water absorption parameter for the load based upon the fluid level value sensed by the fluid level sensor after the amount of water is dispensed into the wash tub; and selecting the load type based upon the determined first and second water absorption parameters.

13. The method of claim 12, wherein selecting the load type includes comparing the first and second water absorption parameters with a plurality of constants associated with the plurality of load types.

14. A method of operating a laundry washing machine of the type including a wash tub disposed within a housing and a water inlet configured to dispense water into the wash tub, the method comprising:

initiating an initial fill phase of a wash cycle by controlling the water inlet to dispense a selected amount of water into the wash tub, wherein the selected amount of water is less than a total amount of water dispensed during the initial fill phase;

sensing a weight value associated with the wash tub with a weight sensor operatively coupled to the wash tub after the selected amount of water has been dispensed by the water inlet;

sensing a fluid level value with a fluid level sensor that senses fluid level in the wash tub after the selected amount of water has been dispensed by the water inlet; and dynamically selecting a load type from among a plurality of load types during the initial fill phase of the wash cycle and prior to completing the initial fill phase based upon the weight and fluid level values.

15. The method of claim 14, wherein selecting the load type is performed while dispensing of water by the water inlet is paused.

16. The method of claim 15, further comprising determining a plurality of fluid level values sensed by the fluid level sensor while pausing dispensing of water by the water inlet, wherein selecting the load type is based upon the plurality of fluid level values.

17. The method of claim 14, wherein selecting the load type is performed while controlling the water inlet to dispense water.

18. The method of claim 14, further comprising determining weight and fluid level values at a plurality of amounts of water dispensed by the water inlet, and selecting the load type based upon the determined weight and fluid level values at the plurality of amounts of water dispensed by the water inlet.

19. The method of claim 14, further comprising controlling the water inlet to dispense additional water for the initial fill phase into the wash tub after selecting the load type.

20. The method of claim 19, further comprising determining an amount of additional water to dispense for the initial fill phase based upon the selected load type.

* * * * *